United States Patent [19]

Bellini

[11] Patent Number: 4,593,593

[45] Date of Patent: Jun. 10, 1986

[54] HOUSING STRUCTURE OF KEYBOARD MUSICAL INSTRUMENT

[75] Inventor: Mario Bellini, Milan, Italy

[73] Assignee: Nippon Gakki Seizo Kabushiki Kaisha, Hamamatsu, Japan

[21] Appl. No.: 684,276

[22] Filed: Dec. 19, 1984

[30] Foreign Application Priority Data

Jan. 26, 1984 [JP] Japan ..... 59-8254[U]

[51] Int. Cl.[4] ..... G10C 3/02

[52] U.S. Cl. ..... 84/177; 84/DIG. 3; 84/DIG. 17

[58] Field of Search ..... 84/177, 178, 179, 180, 84/183, 452 P, DIG. 3, DIG. 17

[56] References Cited

U.S. PATENT DOCUMENTS

| | | | |
|---|---|---|---|
| 743,682 | 11/1903 | Bowen | 84/180 |
| 1,682,122 | 8/1928 | Giese | 84/180 |
| 1,719,016 | 7/1929 | MacDow | 84/180 |
| 3,545,329 | 3/1969 | Roehrig | 84/452 P X |
| 4,334,453 | 6/1982 | Kumano | 84/177 |

FOREIGN PATENT DOCUMENTS 149904 4/1904 Fed. Rep. of Germany ..... 84/179

OTHER PUBLICATIONS

Japanese Design Registration No. 548447.

*Primary Examiner*—L. T. Hix
*Assistant Examiner*—Brian W. Brown
*Attorney, Agent, or Firm*—Blakely, Sokoloff, Taylor & Zafman

[57] ABSTRACT

A housing structure of a keyboard instrument has: a musical instrument main body having a keyboard portion in which a plurality of keys are aligned in order; a cover having a hinge portion and a foldable portion along an alignment direction of the keys so as to open and cover an upper surface of the musical instrument main body; and a cover lock portion formed in the upper surface of the musical instrument main body for locking the cover when the cover is opened and folded at the foldable portion. The hinge portion consists of a flexible synthetic resin which may be formed integrally with the cover or separately from the cover.

9 Claims, 7 Drawing Figures

HOUSING STRUCTURE OF KEYBOARD MUSICAL INSTRUMENT

BACKGROUND OF THE INVENTION

The present invention relates to a housing structure of a keyboard musical instrument and, more particularly, to a housing structure of a keyboard musical instrument which has a lid or cover.

Portable electronic musical instruments such as compact electronic organs, keyboards, and music synthesizers must generally be lightweight and low cost, and, therefore, most of these musical instruments do not have lids or covers but only have separate and optional carrying cases. In order to protect a keyboard section mechanically or from dust or the like, a cover has recently been arranged in the housing, or an operation panel also serves as a cover in some instruments. However, the depth of such a portable electronic musical instrument is limited relative to the longitudinal width thereof. It is therefore difficult to dispose the cover when it is opened. For example, when the cover is opened and stood on the musical instrument main body, a lock mechanism is required for the standing cover, resulting in a complicated structure and untidy appearance. When the cover is opened and laid down on the rear portion of the musical instrument main body, a space to lay the cover must be allowed for. In order to eliminate these drawbacks, the cover may be detachably mounted on the musical instrument main body. In this case, however, the player must decide where the removed cover is to be placed.

SUMMARY OF THE INVENTION

It is a principal object of the present invention to provide a compact housing structure of a keyboard instrument.

It is another object of the present invention to provide a housing structure of a keyboard instrument wherein a cover can be easily disposed.

It is still another object of the present invention to provide a housing structure of a keyboard instrument wherein a cover can be set at a predetermined angle when the cover is opened.

In order to achieve the above objects, there is provided a housing structure of a keyboard instrument, comprising:

a musical instrument main body having a keyboard portion in which a plurality of keys are aligned in order;

a cover having a hinge portion and a foldable portion along an alignment direction of the keys so as to cover an upper surface of the musical instrument main body when the cover is unfolded; and a cover lock portion formed in the upper surface of the musical instrument main body for locking the cover at a predetermined inclination relative to the upper surface of the musical instrument body when the cover is opened and folded at the foldable portion.

DESCRIPTION OF THE PREFERRED EMBODIMENT

Figure 1:
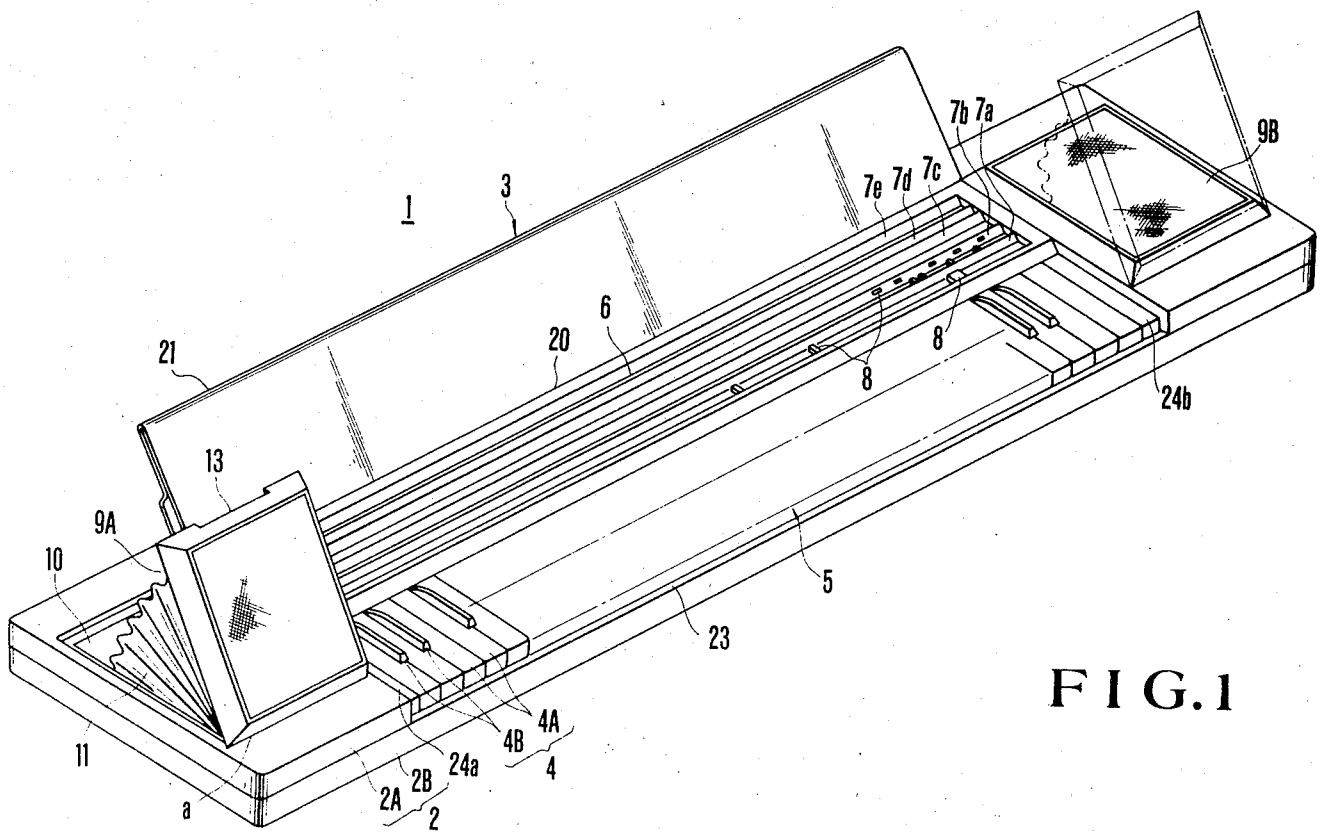
FIG. 1 is a perspective view of a portable electronic musical instrument which employs the present invention in which a cover is opened.
Figure 2:
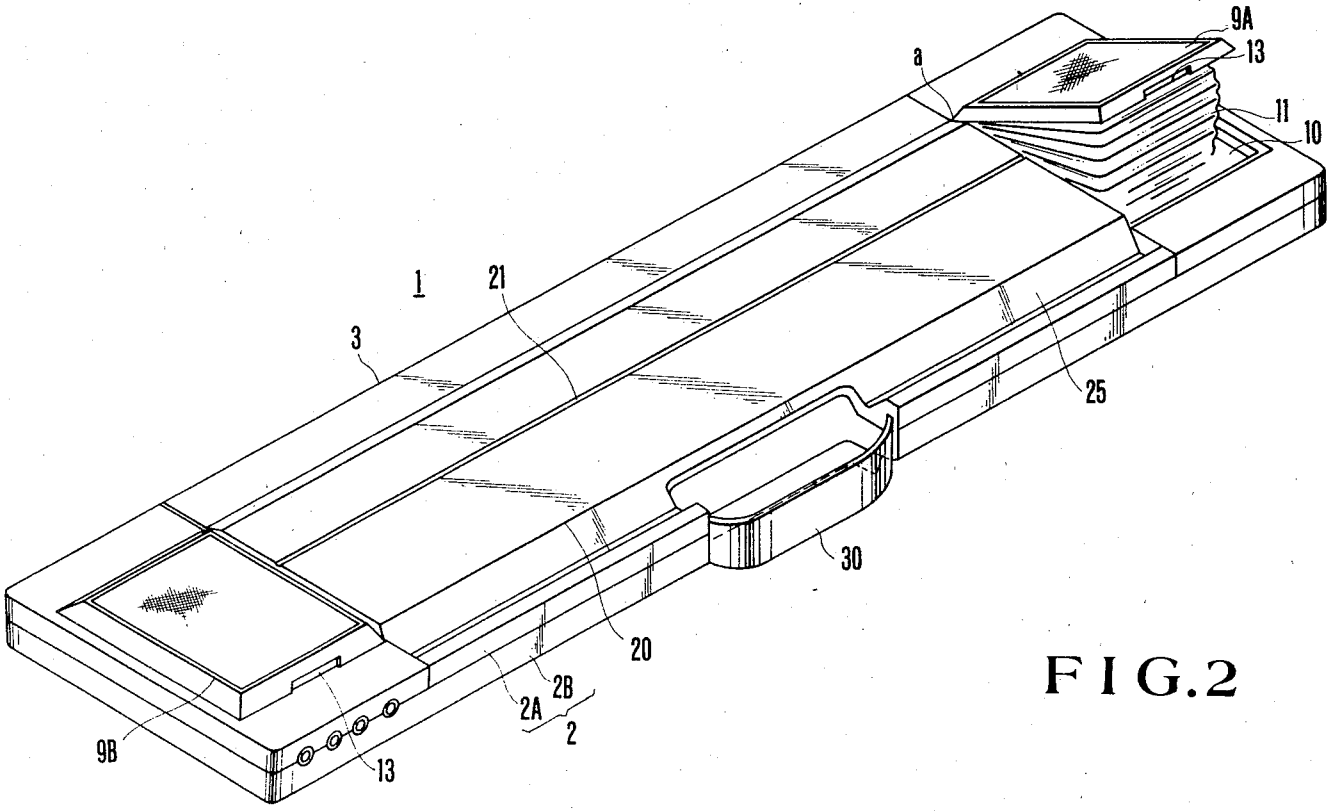
FIG. 2 is a perspective view of the musical instrument of FIG. 1 which is viewed from its rear side when the cover is closed.
Figure 3:
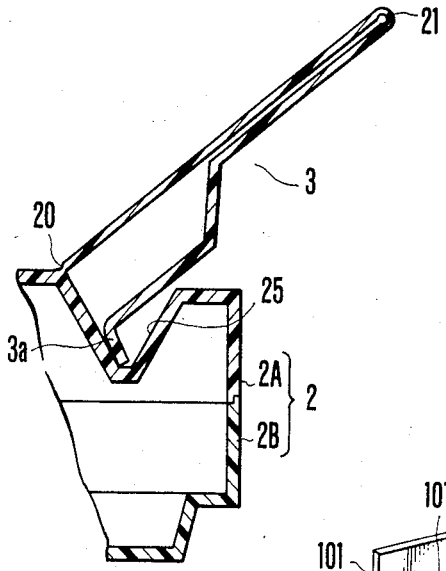
FIG. 3 is an enlarged sectional view showing the cover and a cover lock portion of the musical instrument.

FIGS. 1 to 3 show an embodiment of the present invention which is applied to a portable electronic keyboard instrument. Referring to FIGS. 1 to 3, reference numeral 1 denotes a portable electronic keyboard instrument. The keyboard instrument 1 comprises a shallow box-like main body 2 extending along the right-and-left direction, and a lid or cover 3. The main body 2 has upper and lower cases 2A and 2B which are snugly coupled together. The main body 2 and the cover 3 constitute a musical instrument housing.

A central portion of the upper front panel of the main body 2 is opened, and a keyboard 4 having a number of white keys 4A and black keys 4B is disposed in the opening of the central portion, thereby constituting a keyboard portion 5. An operation panel 6 is arranged behind the keyboard portion 5. This operation panel 6 has inclined surfaces *7a* to *7e* inclined at the same angle and extended along the longitudinal direction of the main body 2 with appropriate spacing between the adjacent surfaces. Electric components 8 such as various operation switches and slide type volume controls (only some of them are shown in FIG. 1) are arranged in the inclined surfaces *7a* to *7e*. Predetermined characters and symbols are displayed on the inclined surfaces *7a* to *7e* to improve operability and to permit visual confirmation.

The main body 2 incorporates various electric components (not shown) such as a plurality of key switches respectively corresponding to the keys 4A and 4B, a printed circuit board for wiring a musical tone producing circuit and a control circuit, and cords. The main body 2 also has a pair of speakers 9A and 9B. When a key switch corresponding to a depressed key is operated, a corresponding musical tone is electrically generated, and the musical tone is produced at one or both of speakers 9A and 9B.

The speakers 9A and 9B are arranged in speaker holding recesses 10 formed at two ends of the main body 2 so as to interpose the keyboard portion 5 therebetween. The speakers 9A and 9B can be raised from the corresponding recesses 10 through corresponding bellows 11, respectively. The arrangement of these speakers does not constitute a part of my invention but is described by way of explanation of the embodiment. The speakers 9A and 9B are respectively pivoted about pivot edges a at a predetermined angle and face toward the front side when used. Therefore, the speakers 9A and 9B are set at a predetermined inclined angle. The angle may be varied in accordance with a known frictional mechanism or a click mechanism. The pivotal movement of the speakers 9A and 9B can be easily performed by respectively hooking fingers of a hand with engaging recesses 13 formed at the rear edges of the speakers 9A and 9B and by pulling up the speakers. However, the speakers may be automatically pivoted by a drive unit such as an electric motor and a solenoid.

The cover 3 as the main feature of the present invention is integrally formed with the upper case 2A. When the electronic keyboard instrument 1 is closed, the cover 3 covers the operation panel 6 and the keyboard portion 5. The rear end portion of the cover 3 is integrally connected to the case 2A through a thin hinge 20 shown in FIG. 3 along the rear edge of the operation panel on the upper surface of the case 2A. Therefore, the hinge 20 becomes the pivot portion of the cover 3 when the cover 3 is opened or closed. A portion of the cover 3 which corresponds to a boundary between the keyboard portion 5 and the operation panel 6 constitutes a hinge 21. When the cover 3 is opened for playing the keyboard instrument, the cover is folded at the hinge 21 such that an inner surface faces outward, as shown in FIGS. 1 and 3. The front end portion of the cover 3 is bent inward at a right angle to constitute a bent portion 3*a* (FIG. 3). The bent portion 3*a* abuts against an upper surface 23 of the front wall portion of the lower case 2B. The front surface 23 constitutes a key slip. The bent portion 3*a* protects the key front of the keys 4A and a pair of end blocks 24*a* and 24*b* disposed at the two ends of the keyboard portion.

A cover lock portion 25 is formed in the upper surface of the upper case 2A immediately behind the cover 3 along the longitudinal direction of the cover 3. The cover lock portion 25 comprises a V-shaped groove for anchoring the bent portion 3*a* when the cover 3 is opened. The cover 3 is folded at the hinge 21, and the bent portion 3*a* is easily fitted in the cover lock portion 25 by laying the cover 3 backward, as shown in FIG. 3. In this locked state, the cover 3 is kept at the same inclined angle as that of the inclined surfaces 7*a* to 7*e*, and the cover will not fall toward the rear portion of the upper surface.

A handle 30 (FIG. 2) is integrally formed with the central portion of the rear surface of the main body 2 so as to allow a player to carry the musical instrument.

According to the construction of the portable electronic keyboard instrument 1, the cover 3 is opened and folded, and the bent portion (front end portion) 3*a* is inserted and locked in the cover lock portion 25 formed in the upper surface of the main body 2. The cover 3 will not fall toward the rear portion of the main body 2 and can be stably held. In addition, the outer appearance of the keyboard instrument can be thus improved. Furthermore, a space for the cover 3 need not be reserved at the rear portion of the main body 2.

Since the cover 3 is inclined at a predetermined angle and is firmly positioned when opened, the folded cover can be used as a music sheet stand. The inclined angle preferably falls within the range between about 30° and about 60°. In this case, a groove for receiving a lower end of a music sheet may be formed between the operation panel 6 and the cover 3. Alternatively, a projection may be formed at a lower and inner surface of the cover 3 to support a music sheet, and a recess for accommodating the projection may be formed in the upper surface of the upper case 2A when the cover is closed.

In the above embodiment, since the cover is integrally formed with the upper case 2A, the cover is made of a flexible plastic resin such as polypropylene, polyester or polystyrene having an impact resistant property so as to provide flexibility to the hinges.

In the above embodiment, the cover 3 is integrally formed with the upper case 2A. However, the present invention is not limited to this arrangement. The cover 3 and the upper case 2A may be independently manufactured. In that case, the cover 3 and the upper case 2A are pivotally coupled through a pivot shaft and a hinge, as shown in FIG. 4.

Figure 4:
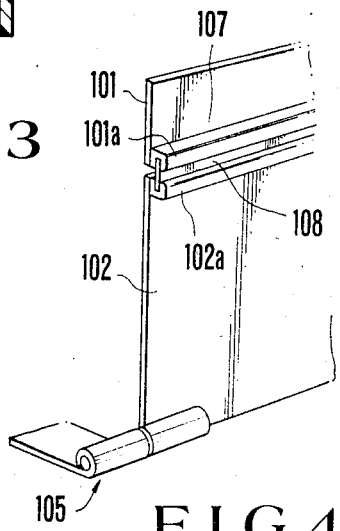
FIG. 4 is an enlarged sectional view showing a modification of the structure shown in FIG. 3.

Referring to FIG. 4, the cover 3 comprises two elongate metal plates 101 and 102. The elongate plate 102 is pivotally coupled to the upper case 2A through a pair of hinge assemblies 105 mounted between two side ends of the plate 102 and the upper case 2A. A foldable portion 107 for flexibly bending the elongate plates 101 and 102 comprises U-shaped metal pieces 101*a* and 102*b* and a flexible member, i.e., an elastomer member 108 for coupling the opposing ends of the metal pieces 101*a* and 102*b*. In this case, the other end (not shown) of the elongate plate 101 may be folded toward the key front in the same manner as in the above embodiment.

In the above embodiment, the cover anchoring portion 25 comprises the V-shaped groove. However, this portion 25 may vary in accordance with the shape of the front end portion of the cover 3.

Figure 5:
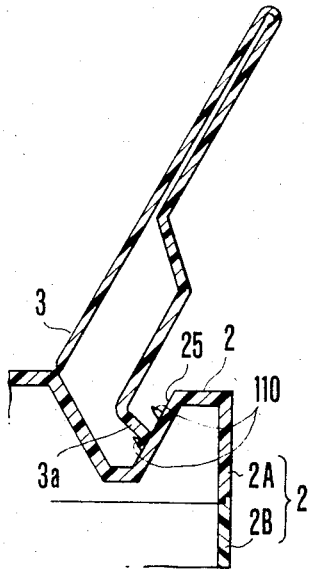
FIG. 5 is an enlarged sectional view showing another modification of the structure shown in FIG. 3.

In the above embodiment, the bent portion 3*a* of the cover 3 is simply inserted in the groove 25. However, as shown in FIG. 5, several projections 110 are formed at an inclined surface of the groove 25 so as to change the inclined angle of the folded cover when the cover is opened.

Figure 6:
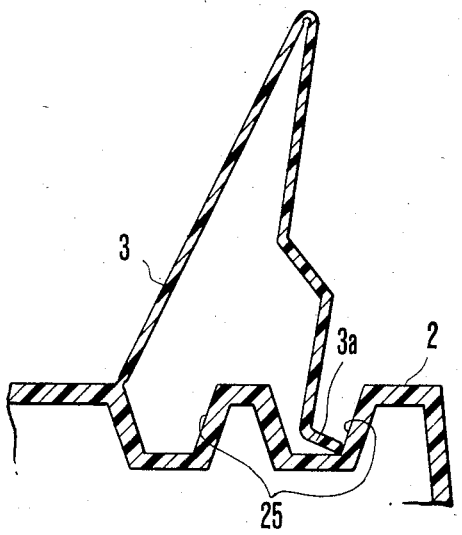
FIG. 6 is an enlarged sectional view showing still another modification of the structure shown in FIG. 3.

In addition, as shown in FIG. 6, a plurality of cover lock recesses 25 may be formed in the upper surface of the main body 2. The bent end portion 3*a* is inserted in a selected one of the recesses 25 to change an inclined angle.

Figure 7:
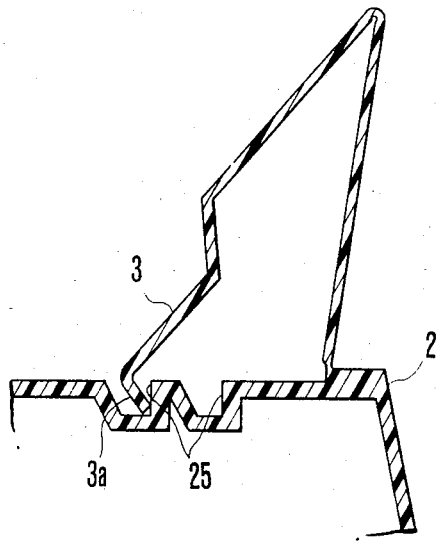
FIG. 7 is an enlarged sectional view showing still another modification of the structure shown in FIG. 3.

In the above embodiment and its modifications, the cover 3 is folded such that the inner surface of the cover faces outward. However, the cover 3 may be folded such that its inner surface faces inward. In this case, the cover lock portion 25 is formed in front of the pivoted portion of the cover 3. A plurality of cover lock portions 25 may be formed, as shown in FIG. 7.

As has been described above, the housing structure of the keyboard instrument of the present invention is obtained wherein a foldable cover is arranged on the upper surface of the musical instrument main body to be opened/closed, a cover lock portion is formed in correspondence with the cover, and the front end of the folded cover is locked by the cover lock portion so as to incline the folded cover at a predetermined angle. The folded cover can be stably and firmly held, so that the cover will not fall toward the rear portion of the main body. The housing structure according to the present invention is simple, and a lock member need not be added. As a result, various practical benefits are obtained wherein the number of components will not be increased, thus providing the housing structure at low cost.

What is claimed is:

1. A housing structure of a portable keyboard electronic musical instrument, comprising:

a musical instrument body having a keyboard portion and an operation panel arranged adjacent to said keyboard portion;

a cover having a hinge portion along alignment direction of said keys so as to swing to open and cover said keyboard portion and said operation panel, and a foldable portion at which said cover is folded when said cover is opened, said cover and said musical instrument body being integrally formed of plastic material to have a relatively thin and flexible portion which constitutes said hinge portion; and a cover lock portion formed in the upper surface of said musical instrument body for locking said cover at a predetermined inclination relative to the upper surface of the musical instrument body when said cover is opened and folded at the foldable portion, whereby a configuration adapted for carriage is accomplished with a combination of said cover and said musical instrument body.

2. A structure according to claim 1, wherein said cover comprises a first plate member extending from the hinge portion to the foldable portion and a second plate member extending from the foldable portion and having a step portion, and the foldable portion comprises a flexible member whose opposing edges are fixed at edges of said first and second plate members, respectively.

3. A structure according to claim 1, wherein said cover lock portion comprises a recess formed in the upper surface of said musical instrument body along the aligning direction of the keys, the recess being formed at a side opposite to the keyboard portion with respect to the hinge portion of said cover, the front end of said cover being locked in the recess when the cover is opened.

4. A structure according to claim 1, wherein said recess comprises a V-shaped groove formed in the upper surface of said musical instrument body along the aligning direction of the keys, and at least one projection is formed on one of inclined surfaces defining the V-shaped groove to support the front end of the opened cover.

5. A structure according to claim 1, wherein said cover lock portion comprises a recess formed in the upper surface of said musical instrument body along the aligning direction of the keys, the recess being formed at the same side as the keyboard portion with respect to the pivot portion of said cover, the front end of said cover being locked in the recess when the cover is opened.

6. A structure according to claim 5, wherein said recess comprises a plurality notches to support the front end of the opened cover at selective inclinations.

7. A structure according to claim 1, wherein said cover comprises a flat portion for covering the upper surface of said musical instrument body and a bent portion extending from the flat portion so as to cover said keyboard portion including key fronts of the keys.

8. A structure according to claim 1, wherein said cover lock portion comprises a recess formed in the upper surface of said musical instrument body along the aligning direction of the keys, the recess being formed at a side opposite to the keyboard portion with respect to the hinge portion of said cover, the front end of said cover being locked in the recess when the cover is opened, and wherein said cover comprises a flat portion for covering the upper surface of said musical instrument body and a bent portion extending from the flat portion so as to cover said keyboard portion including key fronts of the keys and to form said front end.

9. A structure according to claim 8, further comprising a handle mounted on a side surface of said musical instrument body which opposes the keyboard portion.

* * * * *

UNITED STATES PATENT AND TRADEMARK OFFICE

CERTIFICATE OF CORRECTION

PATENT NO. : 4,593,593

DATED : June 10, 1986

INVENTOR(S) : Bellini

It is certified that error appears in the above-identified patent and that said Letters Patent is hereby corrected as shown below:

| COLUMN | LINE | |
|---|---|---|
| 2 | 61 | Please delete "pivot edges a" and insert --pivot edges a-- |

Signed and Sealed this

Seventh Day of April, 1987

*Attest:*

DONALD J. QUIGG

*Attesting Officer*

*Commissioner of Patents and Trademarks*